US005848336A

United States Patent [19]

Hazama et al.

[11] Patent Number: 5,848,336

[45] Date of Patent: Dec. 8, 1998

[54] ELECTROSTATIC LATENT IMAGE DEVELOPER WITH SHAFT BEARING MEMBERS

[75] Inventors: Hiroyuki Hazama; Yoshiyuki Takeda; Nobuhiro Nakajima, all of Osaka, Japan

[73] Assignee: Mita Industrial Co., Ltd., Osaka, Japan

[21] Appl. No.: 962,691

[22] Filed: Nov. 3, 1997

[30] Foreign Application Priority Data

Nov. 18, 1996 [JP] Japan ..... 8-306601

[51] Int. Cl.[6] ..... G03G 15/06

[52] U.S. Cl. ..... 399/222; 399/265

[58] Field of Search ..... 399/222, 119, 399/111, 265, 279

[56] References Cited

U.S. PATENT DOCUMENTS 5,283,616 2/1994 Numagami et al. ..... 399/111
5,640,229 6/1997 Nakahara ..... 399/119
5,752,132 5/1998 Hazama et al. ..... 399/111

*Primary Examiner*—S. Lee
*Attorney, Agent, or Firm*—Beveridge, DeGrandi, Weilacher & Young, LLP

[57] ABSTRACT

An electrostatic latent image developing device equipped with a developing housing, a developing roller rotatably disposed between the two side walls of the developing housing, and a feeding roller rotatably disposed between the two side walls of the developing housing neighboring the developing roller. A first bearing member is mounted on one side wall and has two bearings for supporting the ends of the rotary shafts of the developing roller and the feeding roller. A second bearing member is mounted on the other side wall and has a bearing for supporting the opposite end of either the rotary shaft of the developing roller or the feeding roller. A third bearing member is mounted on the other side wall and has a bearing for bearing support of the opposite end of the rotary shaft of the developing roller or the feeding roller not supported in bearing fashion by the second bearing member. The second bearing member and the third bearing member are provided with a positioning device for defining a relative positional relationship between the second and third bearing members.

4 Claims, 6 Drawing Sheets

ELECTROSTATIC LATENT IMAGE DEVELOPER WITH SHAFT BEARING MEMBERS

FIELD OF THE INVENTION

The present invention relates to an electrostatic latent image developing device for developing an electrostatic latent image formed on an image carrier in an image-forming machine such as an electrostatic copier or a laser printer.

DESCRIPTION OF THE PRIOR ART

Image-forming machines widely employ an electrostatic latent image developing device of the type which develops an electrostatic latent image into a toner image using a developing agent comprising a one-component toner. The electrostatic latent image developing device of this type comprises a developing housing equipped with a developing chamber and a stirrer chamber; a developing roller which is disposed in said developing chamber, holds the developing agent on the peripheral surface thereof in a developing agent-holding zone, and conveys the thus held developing agent to the developing zone to apply it to the electrostatic latent image; a feeding roller which is a feeding means disposed in the developing chamber and feeds the developing agent onto the peripheral surface of the developing roller in the developing agent-holding zone; a stirrer means which is disposed in the stirrer chamber, stirs the developing agent fed through a developing agent feed port and sends the stirred developing agent into the developing chamber; and a developing agent-limiting means which acts on the peripheral surface of the developing roller in a developing agent-limiting zone located between the developing agent-holding zone and the developing zone in order to limit the amount of the developing agent held on the peripheral surface of the developing roller.

The developing roller is constituted by a rotary shaft and a solid synthetic rubber roller secured to the outer peripheral surface of the rotary shaft, the rotary shaft being rotatably supported by the developing housing via bearings. The feeding roller, too, is constituted by a rotary shaft and a roller of a foamed material such as foamed silicon or foamed urethane secured to the outer peripheral surface of the rotary shaft, the rotary shaft being rotatably supported by the developing housing via bearings. It is necessary that the developing roller and the feeding roller must maintain a distance between their shafts highly accurately. In order to support a plurality of shafts accurately maintaining distances among them, in general, a constitution has been employed in which a bearing member is provided with a plurality of bearing portions so that a plurality of shafts are supported by a single bearing member.

However, since the developing roller and the feeding roller are assembled in a state of being press-contacted to each other, it is difficult from an aspect of assembling operation to support their ends using a single bearing member. Therefore, a constitution has been heretofore actually employed in which the developing roller and the feeding roller are supported by separate bearing members.

SUMMARY OF THE INVENTION

It is an object of the present invention to provide an electrostatic latent image developing device equipped with a bearing structure capable of accurately supporting the developing roller and the feeding roller and facilitates the assembling operation.

In order to accomplish the above-mentioned object according to the present invention, there is provided an electrostatic latent image developing device equipped with a developing housing, a developing roller rotatably disposed between the two side walls of said developing housing for holding the developing agent on the peripheral surface thereof and for applying the thus held developing agent onto an electrostatic latent image, and a feeding roller rotatably disposed between the two side walls of said developing housing neighboring said developing roller in order to feed the developing agent onto the peripheral surface of said developing roller, comprising:

a first bearing member mounted on one side wall of said developing housing and having two bearings for supporting an end of the rotary shaft of said developing roller and an end of the rotary shaft of said feeding roller;

a second bearing member mounted on the other side wall of said developing housing and having a bearing for supporting the other end of the one rotary shaft of said developing roller or said feeding roller; and a third bearing member mounted on the other side wall of said developing housing and having a bearing for supporting the other end of the other rotary shaft of said developing roller or said feeding roller;

said second bearing member and said third bearing member being provided with a positioning means for defining a relative positional relationship between the two.

According to the present invention, furthermore, there is provided an electrostatic latent image developing device equipped with a developing housing, a developing roller rotatably disposed between the two side walls of said developing housing for holding the developing agent on the peripheral surface thereof and for applying the thus held developing agent onto an electrostatic latent image, and a feeding roller rotatably disposed between the two side walls of said developing housing neighboring said developing roller in order to feed the developing agent onto the peripheral surface of said developing roller, comprising:

a first bearing member mounted on one side wall of said developing housing and having two bearings for supporting an end of the rotary shaft of said developing roller and an end of the rotary shaft of said feeding roller;

a second bearing member mounted on the other side wall of said developing housing and having a positioning boss with an insertion hole by which is temporarily supported the other end of the one rotary shaft of said developing roller or said feeding roller; and a third bearing member mounted on the other side wall of said developing housing and having a bearing for supporting the other end of the other rotary shaft of said developing roller or said feeding roller;

said third bearing member being provided with a fitting recess which fits to said positioning boss provided on said second bearing member, and an end wall forming said fitting recess being provided with a bearing for supporting the end of the rotary shaft inserted in said insertion hole formed in said positioning boss.

Other features of the present invention will become obvious from the following description.

DETAILED DESCRIPTION OF THE PREFERRED EMBODIMENTS

Described below in detail with reference to the accompanying drawings is an electrostatic latent image developing device constituted according to an embodiment of the present invention. Here, in the illustrated embodiment, the electrostatic latent image developing device that is constituted according to the present invention is applied to a printer as an image-forming machine.

Figure 1:
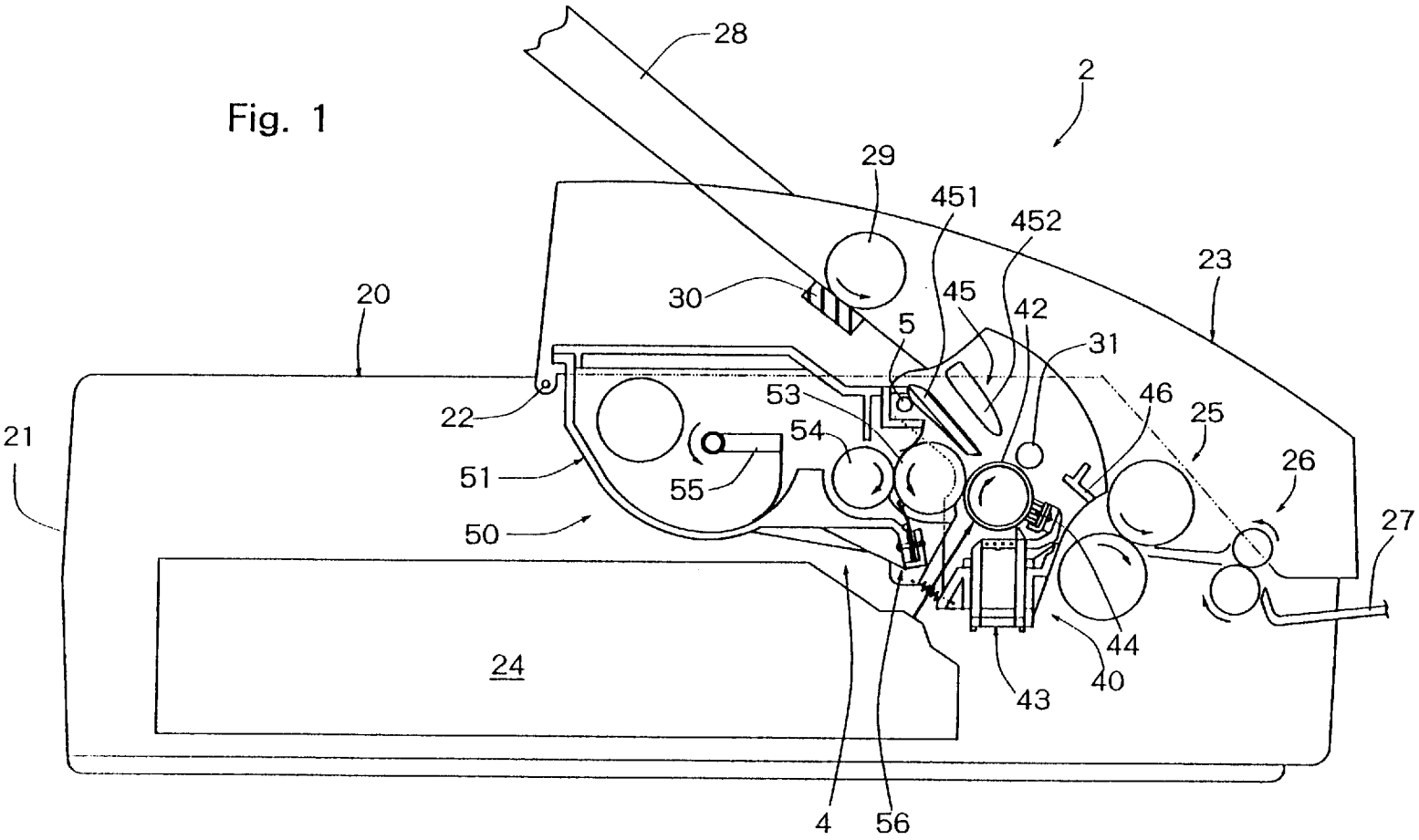
FIG. 1 is a front view schematically illustrating an image-forming machine equipped with an electrostatic latent image developing device constituted according to an embodiment of the present invention.

FIG. 1 schematically illustrates a printer a constituted according to an embodiment of the present invention. In this embodiment, the printer 2 is a small-sized, low-speed laser printer used for a word processor and the like, and has a machine housing 20 formed by molding a plastic material. The machine housing 20 includes a box-shaped housing body 21 of which the upper side is open, and a cover 23 mounted to turn on a shaft 22 disposed at the upper part of the housing body 21. A process unit 4 is detachably mounted nearly in the central portion in the machine housing 20 constituted as described above.

Figure 2:
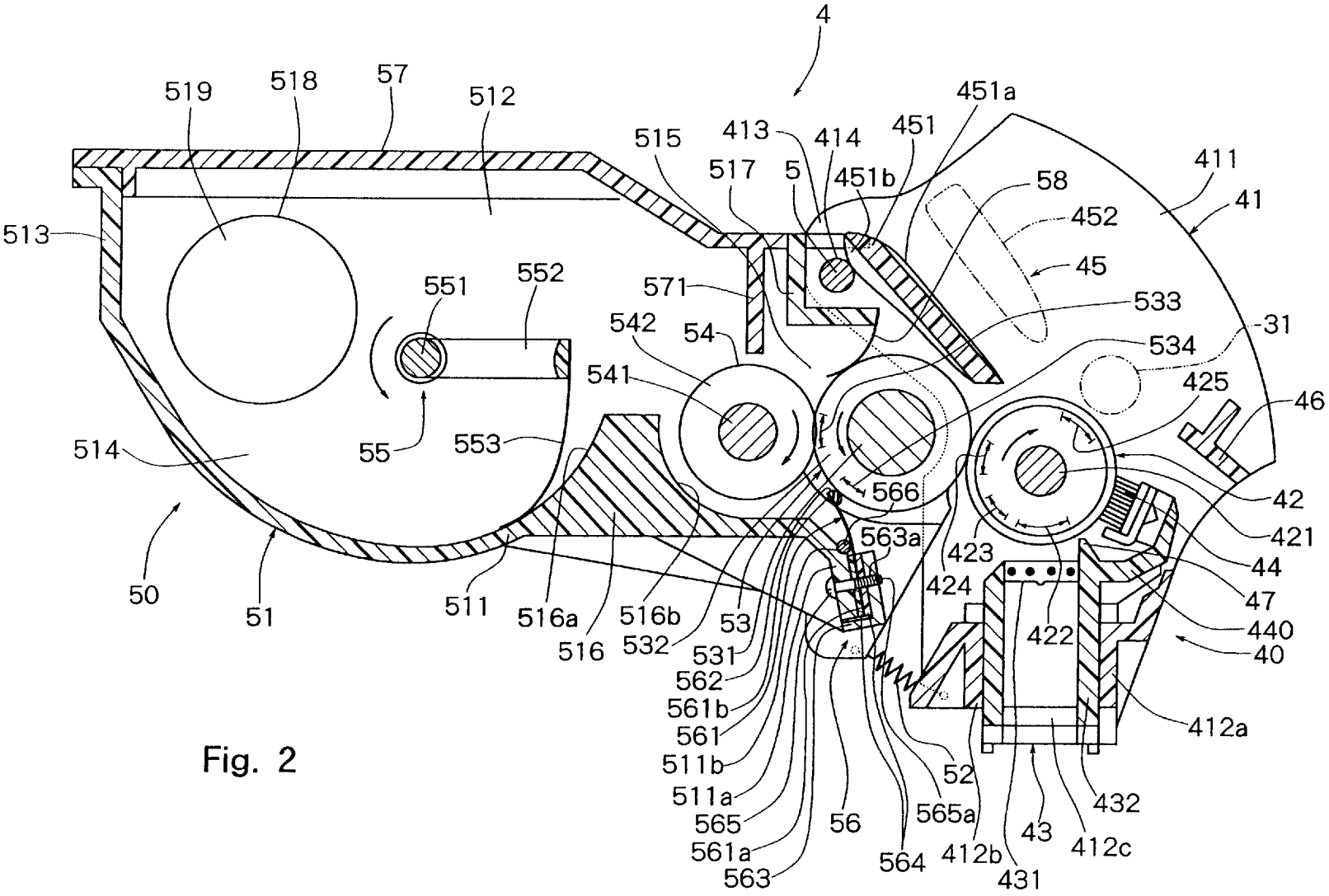
FIG. 2 is a sectional view of the image-forming machine equipped with the electrostatic latent image developing device constituted according to the present invention shown in FIG. 1.

The process unit 4, as shown in FIG. 2, has a photosensitive unit 40 and a developing unit 50 in which an electrostatic latent image developing device is formed as a unitary structure, the developing unit 50 being pivotally supported by the photosensitive unit 40 via a support shaft 5. The photosensitive unit 40 has a photosensitive drum support means 41. The photosensitive drum support means 41 has a pair of side wall members 411 (FIG. 2 illustrates the side wall member of the back side only) arranged, spaced from each other, in the back-and-forth direction, and coupling members 412*a* and 412*b* for coupling the lower portions of the pair of side wall members 411 together. The coupling members 412*a* and 412*b* have inner surfaces opposed to each other in parallel, and between these coupling members is formed a space 412*c* for mounting an electric charging means that will be described later. The space 412*c* for mounting an electric charging means is located being opposed to a charging zone that will be described later. The thus constituted photosensitive drum support means 41 is formed as a unitary structure by molding a plastic material. Support portions 413 having mounting holes 414 are provided at the upper end portions of the pair of side wall members 411 constituting the photosensitive drum support means 41 on the side of the developing unit 50. By inserting a support shaft 5 which is a metal rod disposed in a developing housing, that will be described later, of the developing unit 50 in the mounting holes 414 of the support portions 413, the photosensitive unit 40 and the developing unit 50 are supported to be allowed to turn relative to each other.

The photosensitive unit 40 has a photosensitive drum 42 having a photosensitive layer formed on the peripheral surface thereof. The photosensitive drum 42 has a rotary shaft 421 rotatably supported by the pair of side wall members 411 constituting the photosensitive drum support means 41, and is rotated by a drive means that is not shown in a direction of an arrow to pass successively through a charging zone 422, an electrostatic latent image-forming zone 423, a developing zone 424 and a transfer zone 425. In a charging means-mounting space 412*c* located in the charging zone 422 is mounted a charging means 43 that is opposed to the peripheral surface of the lower side of the photosensitive drum 42. The charging means 43 includes a corona discharger 431 arranged in parallel with the photosensitive drum 42 along the axial direction and working as an electric charger, and a charger-holding member 432 made of a plastic material to hold the corona discharger 431. The charging means 43 is placed in a predetermined position as the charger-holding member 432 is fitted to the charging means-mounting space 412*c*. Between the charging zone 422 and the transfer zone 425 is disposed a foreign matter-recovering brush 44 in contact with the peripheral surface of the photosensitive drum 42 and along the axial direction of the photosensitive drum 42. The foreign matter-recovering brush 44 is made of an acrylic fiber or the like, has nearly the same length as the length of the photosensitive drum 42 in the axial direction thereof, and is mounted on a brush support member 440 molded as a unitary structure with the charger-holding member 432 and disposed along the axial direction of the photosensitive drum 42. The upper end of the charger-holding member 432 is so protruded as to approach the peripheral surface of the photosensitive drum 42 between the corona discharger 431 for electric charging disposed in the charging zone 422 and the foreign matter-recovering brush 44 to constitute a toner infiltration prevention wall 47. The residual toner on the peripheral surface of the photosensitive drum 42 is removed together with foreign matter such as paper dust by the foreign matter-recovering brush 44. However, when the residual toner is not reliably trapped by the foreign matter-recovering brush 44 but falls, the wall 47 works to prevent the toner from infiltrating into the corona discharger 431 As a result, the toner is prevented from moving owing to the toner infiltration prevention wall 47, and deposits on a horizontal piece portion near the toner infiltration prevention wall 47 of the brush support member 440.

Between the pair of side wall members 411 constituting the photosensitive drum support means 41, there is disposed a lower guide plate 451 constituting one of a pair of pre-transfer guide plates 45 for guiding a transfer paper, which is fed from the upper left side in FIG. 2, toward the transfer zone 425 on the peripheral surface of the photosensitive drum 42. The lower guide plate 451 is molded integrally with the pair of side wall members 411. On the upper surface of the lower guide plate 451 are integrally formed a plurality of guide ribs 451*a* at regular intervals in the lengthwise direction (in a direction perpendicular to the surface of the paper in FIG. 2). The lower guide plate 451 further has, integrally formed on the lower surface thereof, a plurality of reinforcing ribs 451*b* at regular intervals in the lengthwise direction thereof (direction perpendicular to the surface of the paper in FIG. 2), the reinforcing ribs 451*b* being in contact with the support shaft 5. Therefore, the lower guide plate 451 is prevented from being deflected even when a pushing force is exerted on the upper surface thereof, because the reinforcing ribs 451*b* come into contact with the support shaft 5. Moreover, the lower guide plate 451 works as a coupling member for coupling together the upper portions of the pair of side wall members 411 constituting the photosensitive drum support means 41, and contributes to enhancing the rigidity of the photosensitive drum support means 41. In the illustrated embodiment, furthermore, since the lower guide plate 451 is integrally formed on the pair of side wall members 411, it can highly precisely maintain a positional relationship with respect to the photosensitive drum 42 that is rotatably supported by the pair of side wall members 411. In the illustrated embodiment, furthermore, the lower guide plate 451 also works as a member for preventing the contact with the photosensitive layer on the photosensitive drum 42 at the time when the process unit is attached or detached, works as a member for preventing the developing unit 50 from coming into contact with a developing roller that will be described later, and works to prevent the toner scattered from the surface of the developing roller from adhering onto the transfer paper or the passage for conveying the transfer paper.

Between the pair of side wall members 411 constituting the photosensitive drum support means 41 is disposed a post-transfer guide plate 46 for guiding the transfer paper, on which the toner image has been transferred in the transfer zone 425, to a fixing means that will be described later, the post-transfer guide plate 46 being integrally formed on the pair of side wall portions 411. Therefore, the post-transfer guide plate 46 works as a coupling member for coupling together the pair of side wall portions 411 that constitute the photosensitive drum support means 41, and enhances the rigidity of the photosensitive drum support means 41. The guide plate 46 in the illustrated embodiment also works for preventing the contact to the photosensitive layer of the photosensitive drum 42 at the time when the process unit is attached or detached.

Next, described below is the developing unit 50 which works as an electrostatic latent image developing device. The developing unit 50 in the illustrated embodiment is equipped with a developing housing 51 which holds a developing agent comprising a one-component toner. The developing housing 51 is constituted by a bottom wall 511, a front side wall 510 and a rear side wall 512 (the rear side wall only is shown in FIG. 2) erected upright from the front and rear ends (ends in a direction perpendicular to the surface of the paper in FIG. 2) of the bottom wall 511, and a left side wall 513. These walls are integrally formed by molding a plastic material, and define a stirrer chamber 514 and a developing chamber 515. On the bottom wall 511 constituting the developing housing 51 is integrally formed a partitioning wall 516 in the back-and-forth direction (direction perpendicular to the surface of the paper in FIG. 2) between the stirrer chamber 514 and the developing chamber 515. Both the right and left surfaces of the partitioning wall 516 are formed as arcuate guide surfaces 516*a* and 516*b*. Between the front and rear side walls 510, 512 constituting the developing housing 51 is provided a coupling member 517 at an upper part on the side of the developing chamber 515, integrally with the front and rear side walls 510, 512. A toner supply hole 518 is formed in the rear side wall 512 constituting the developing housing 51, and is fitted with a cap 519. At an upper end portion on the side of the developing chamber 515 of the thus constituted developing housing 51 is disposed the support shaft 5 penetrating through the front and rear side walls 510, 512. Both ends of the support shaft 5 are fitted to mounting holes 414 formed in the support portions 413 of the pair of side wall members 411 constituting the photosensitive drum support means 41 for supporting the photosensitive unit 40, so that the photosensitive unit 40 and the developing unit 50 are supported to turn relative to each other. Coil springs 52 that is a resilient means are interposed between the front end at the lower part of the photosensitive drum support means 41 for supporting the photosensitive unit 40 and the rear end at the lower part of the developing housing 51. Due to these coil springs 52, the photosensitive drum support means 41 and the developing housing 51 are engaged to be drawn toward each other with the support shaft 5 as a fulcrum. The developing housing 51 is open at its upper side and right side, i.e., is open on the side of the photosensitive unit 40.

In the developing housing 51 are arranged a developing roller 53, a feeding roller 54, a stirrer means 55 and a developing agent-limiting means 56.

The developing roller 53 is disposed in the developing chamber 515 of the developing housing 51, and includes a rotary shaft 531 rotatably mounted on the front and rear side walls 510, 512 constituting the developing housing 51 by a bearing member that will be described later, and a solid synthetic rubber roller 532 secured to the outer peripheral surface of the rotary shaft 531. The rotary shaft 531 can be formed of a suitable metallic material such as stainless steel. The solid synthetic rubber roller 532 is composed of a relatively soft and electrically conducting material, e.g., an electrically conducting solid synthetic rubber such as an urethane rubber. In the illustrated embodiment, the solid synthetic rubber roller 532 has a surface roughness on the peripheral surface thereof, i.e., has a 10-point average roughness Rz of from 5.0 to 12.0 as measured in compliance with JIS B 0601. Furthermore, the solid synthetic rubber roller 532 has a volume resistivity of from about $10^4$ to about $10^9$ Ωcm. In the illustrated embodiment, furthermore, the solid synthetic rubber roller 532 has a roller hardness or Asker C hardness of from 60 to 80. The thus constituted roller 532 of the developing roller 53 is exposed through the right-side opening formed in the developing housing 51, and is positioned being opposed to the photosensitive drum 42. The peripheral surface of the roller 532 constituting the developing roller 53 is press-contacted against the peripheral surface of the photosensitive drum 42 in the developing zone. In the thus pressed nip portion, the peripheral surface of the roller 532 is elastically compressed to some extent. The rotary shaft 531 of the developing roller 53 is driven by a drive means which is not shown, in the direction of an arrow, i.e., from the lower side toward the upper side in the developing zone where the roller 532 and the photosensitive drum 42 are in contact with each other. With the rotation of the rotary shaft 531, the roller 532 is rotated in the direction of the arrow, too, so that the peripheral surface of the roller 532 moves on successively a developing agent-holding zone 533, a developing agent-limiting zone 534 and a developing zone 424. In the illustrated embodiment, a constant voltage of 300 V is applied to the rotary shaft 531 of the developing roller 53.

The feeding roller 54 is disposed in the developing chamber 515 in the developing housing 51 in parallel with the developing roller 53, and includes a rotary shaft 541 rotatably mounted on the front and rear side walls 510, 512 constituting the developing housing 51 by a bearing member that will be described later, and a roller 542 secured to the outer peripheral surface of the rotary shaft 541. Like the rotary shaft 531, the rotary shaft 541 can be made of a suitable metallic material such as stainless steel. The roller 542 is made of a foamed material such as foamed silicone or foamed urethane. The roller 542 is pressed against the roller 532 of the developing roller 53 in the developing agent-holding zone 533 that is a nip portion constituted by the roller 542 and the developing roller 53. It is desired that the hardness of the foamed material constituting the roller 542 of the feeding roller 54 is considerably smaller (e.g., Asker C hardness of about 35) than the hardness of the roller 532 constituting the developing roller 53, and that the roller 542 is elastically compressed by about 0.1 to 0.6 mm in the nip region upon press-contacting the roller 542 with the roller 532 of the developing roller 53. The roller 542, too, has an electrically conducting property and has a volume resistivity of about $10^2$ to $10^6$ Ωcm. The rotary shaft 541 of the feeding roller 54 is driven by a drive means that is not shown in a direction indicated by an arrow, i.e., from the upper side toward the lower side in the developing agent-holding zone 533 that is a nip portion constituted by the roller 542 and the roller 532 of the developing roller 53. With the rotation of the rotary shaft 541, the roller 542 is rotated in the direction indicated by arrow. In the illustrated embodiment, a constant voltage of 450 V which is higher than the voltage applied to the developing roller 53 is applied to the rotary shaft 541 of the feeding roller 54.

There exists a relationship $V1 < V2 < V3$ among the peripheral velocity V1 of the photosensitive drum 42, peripheral velocity V2 of the developing roller 53, and peripheral velocity V3 of the feeding roller 54. In the illustrated embodiment, a relationship $1.2\ V1 \leqq V2 \leqq 2.5\ V1$ is set between the peripheral velocity V1 of the photosensitive drum 42 and the peripheral velocity V2 of the developing roller 53, and a relationship $1.0\ V2 \leqq V3 \leqq 2.0\ V2$ is set between the peripheral velocity V2 of the developing roller 53 and the peripheral velocity V3 of the feeding roller 54. When the peripheral velocity V2 of the developing roller 53 becomes smaller than 1.2 V1, the developing agent is not sufficiently supplied to the photosensitive drum 42 and hence, the image density decreases. When the peripheral velocity V2 of the developing roller 53 becomes smaller than 1.2 V1, the scraping action of the developing roller 53 decreases against the developing agent that is not transferred but remains adhered onto the photosensitive drum 42 after the transfer operation. As a result, there occurs a so-called offset fogging which is caused due to the presence of the not-transferred developing agent that remains adhered on the photosensitive drum 42. When the peripheral velocity V2 of the developing roller 53 becomes greater than 2.5 V1, on the other hand, the driving torque of the developing roller 53 is increased, and scattering of the developing agent is caused due to a centrifugal force. When the peripheral velocity V3 of the feeding roller 54 becomes smaller than 1.0 V2, the developing agent is not sufficiently supplied to the developing roller 53 and hence, the image density decreases. When the peripheral velocity V3 of the feeding roller 54 becomes smaller than 1.0 V2, only a small scraping action is produced by the feeding roller 54 for the peripheral surface of the developing roller 53. In case the developing agent without being transferred but is adhering to the photosensitive drum 42 after the transfer operation, adheres to the developing roller 53, therefore, it becomes difficult to remove the developing agent, i.e., the developing agent that remains adhered becomes a cause of so-called ghost phenomenon that appears in the developing of the next time. When the peripheral velocity V3 of the feeding roller 54 becomes greater than 2.0 V2, on the other hand, the feeding roller 54 to be driven requires an increased torque and consequently, the developing agent tends to stay on the upper side of the nip portion formed by the feeding roller 54 and the developing roller 53, resulting in an insufficient supply of the developing agent to the developing roller 53.

Next, described below with reference to FIGS. 3 to 7 is a bearing structure for rotatably supporting the developing roller 53 and the feeding roller 54.

Figure 3:
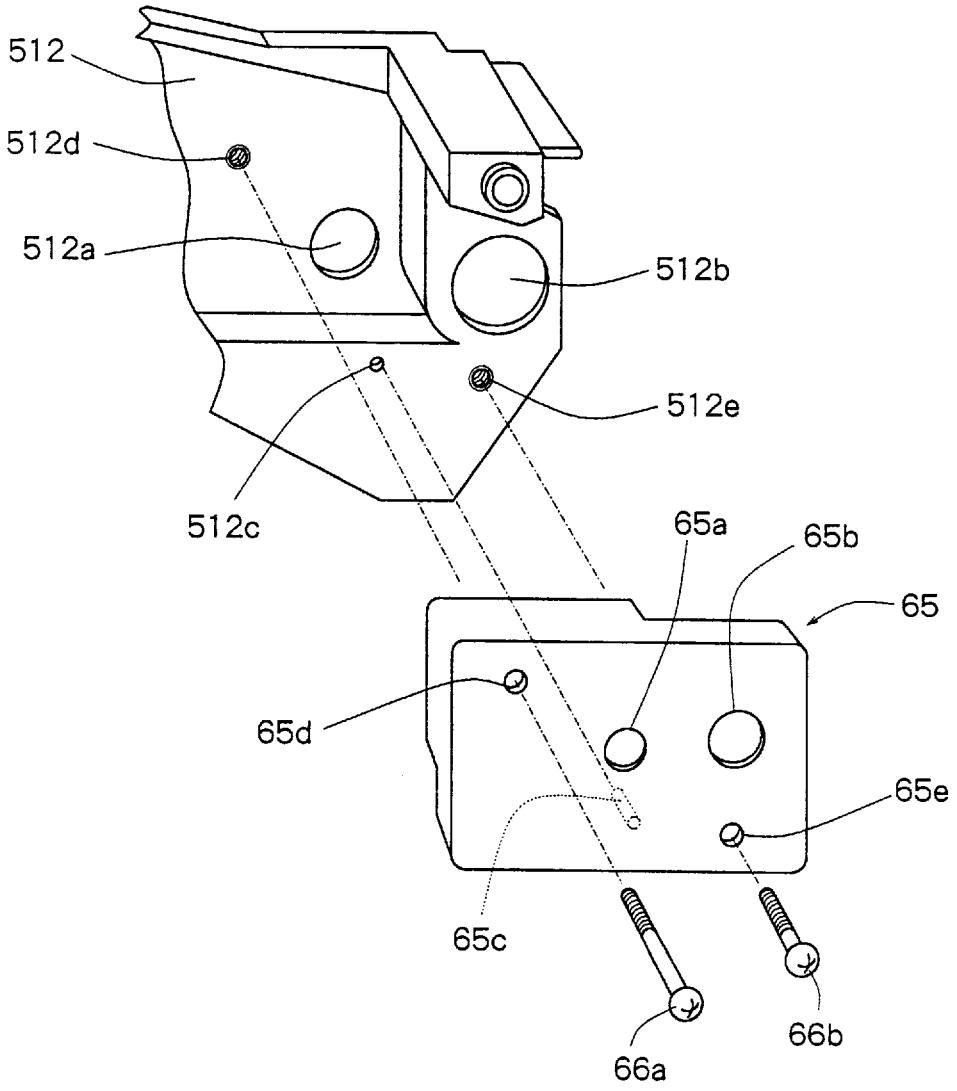
FIG. 3 is a perspective view illustrating, in a disassembled manner, major portions of a bearing structure for supporting an end of a developing roller and an end of a feeding roller constituting the electrostatic latent image developing device shown in FIG. 2.

Referring to FIG. 3, in the roller support portion of the rear side wall 512 of the developing housing 51 are formed a hole 512*a* in which will be inserted an end of the rotary shaft 541 constituting the feeding roller 54 and a hole 512*b* in which will be inserted an end of the rotary shaft 531 constituting the developing roller 53. In the roller support portion of the rear side wall 512 are further formed a positioning hole 512*c* and two threaded holes 512*d* and 512*e*. A first bearing member 65 is mounted on the outer side of the roller support portion of the thus constituted rear side wall 512.

The first bearing member 65 is made of a suitable plastic material and is provided with a bearing 65*a* for rotatably supporting an end of the rotary shaft 541 constituting the feeding roller 54 and with a bearing 65*b* for rotatably supporting an end of the rotary shaft 531 constituting the developing roller 53. The first bearing member 65 is further provided, as a unitary structure, with a positioning projection 65*c* that fits to the positioning hole 512*c*, and with two screw insertion holes 65*d* and 65*e* at positions corresponding to the two threaded holes 512*d* and 512*e*. To mount the thus constituted first bearing member 65 on the rear side wall 512 of the developing housing 51, an end of the rotary shaft 541 constituting the feeding roller 54 inserted in the hole 512*a* of the rear side wall 512 is fitted to the hole of the bearing 65*a* and an end of the rotary shaft 531 constituting the developing roller 53 inserted in the hole 512*b* of the rear side wall 512 is fitted to the hole of the bearing 65*b* while the positioning protrusion 65*c* is being fitted to the positioning hole 512*c* to guide the rotary shafts. Then, screws 66*a* and 66*b* are inserted in the screw insertion holes 65*d* and 65*e*, and are screwed into the threaded holes 512*d* and 512*e* formed in the rear side wall 512, so that the first bearing member 65 is mounted on the rear side wall 512 of the developing housing 51 at a predetermined position.

Figure 4:
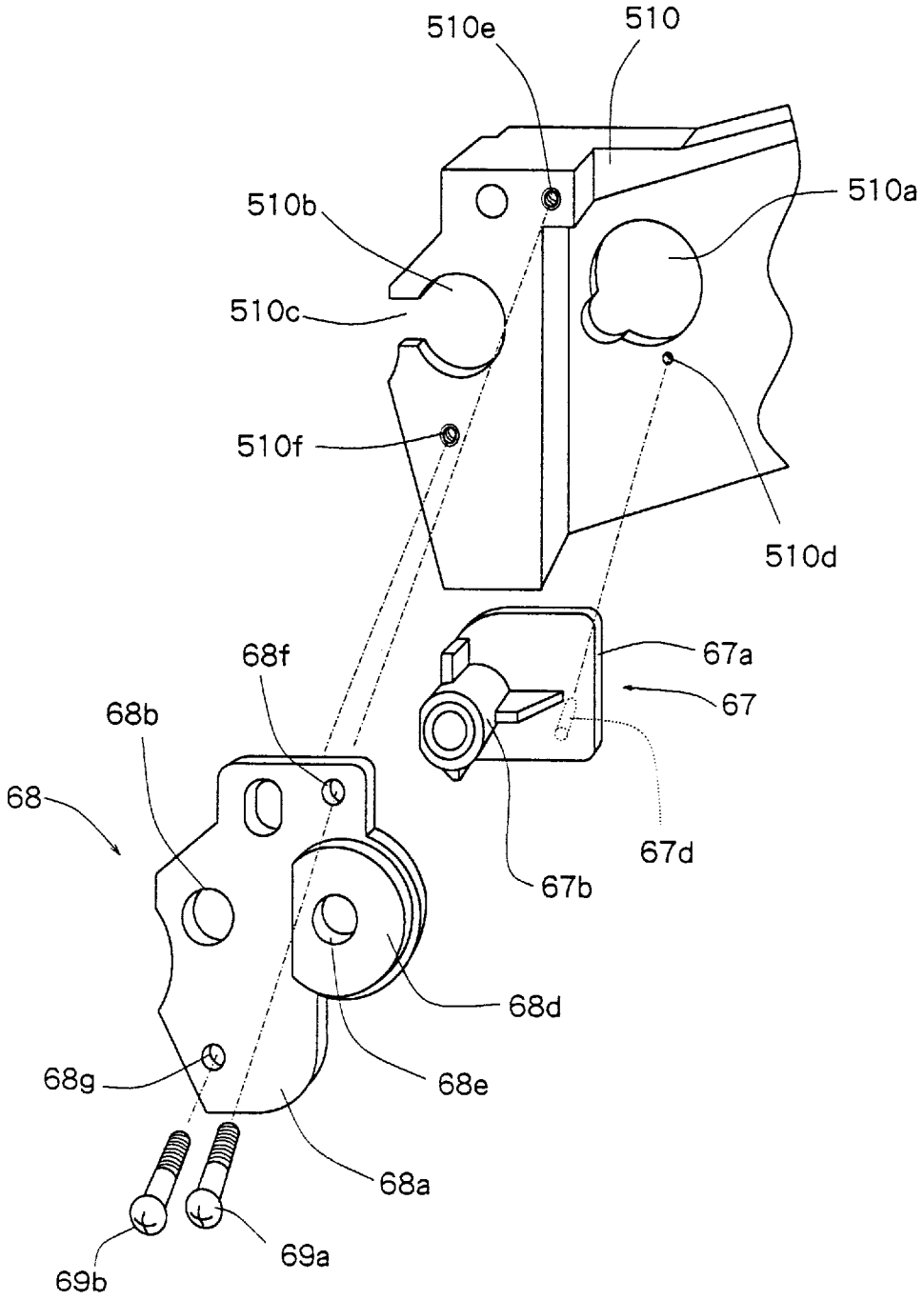
FIG. 4 is a perspective view illustrating, in a disassembled manner, major portions of a bearing structure for supporting the other end of the developing roller and the other end of the feeding roller constituting the electrostatic latent image developing device shown in FIG. 2.

Referring to FIG. 4, in the roller support portion of the front side wall 510 of the developing housing 51 are formed a positioning hole 510*a* for a second bearing member 67, that will be described later, for supporting the other end of the rotary shaft 541 constituting the feeding roller 54, and a hole 510*b* into which will be inserted the other end of the rotary shaft 531 constituting the developing roller 53. On the left side of the hole 510*b* is formed an opening 510*c* having a gap size which permits passage of the rotary shaft 531 of the developing roller 53. In the roller support portion of the front side wall 510 are further formed a positioning hole 510*d* and two threaded holes 510*e* and 510*f*. The second bearing member 67 and the third bearing member 68 are mounted on the outer side of the roller support portion of the thus constituted front side wall 510.

Figure 5:
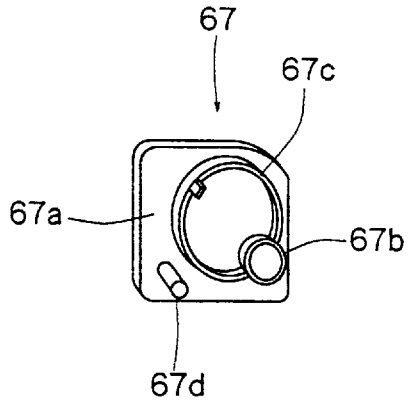
FIG. 5 is a perspective view of a second bearing member constituting the bearing structure shown in FIG. 4.

Next, the second bearing member 67 will be described with reference also to FIG. 5. The second bearing member 67 is made of a suitable plastic material, and includes a main body 67*a*, a bearing 67*b* that is provided in the main body 67*a* and rotatably supports the other end of the rotary shaft 541 constituting the feeding roller 54, a positioning protrusion 67*c* that protrudes from the back surface of the main body 67*a* and corresponds to the positioning hole 510*a* formed in the front side wall 510, and a positioning projection 67*d* that projects from the back surface of the main body 67*a* and fits to the positioning hole 510*d* in the front side wall 510. The bearing 67*b* has a boss which protrudes from the surface of the main body 67*a* and constitutes part of a positioning means that will be described later. To mount the thus constituted second bearing member 67 on the front side wall 510 of the developing housing 51, while the positioning projection 67*d* is fitted to the positioning hole 510*d* and the positioning protrusion 67*c* is being fitted to the positioning hole 510*a* to guide the rotary shaft, the other end of the rotary shaft 541 constituting the feeding roller 54 inserted in the hole 510*a* of the front side wall 510 is fitted to the hole of the bearing 67*b*.

Figure 6:
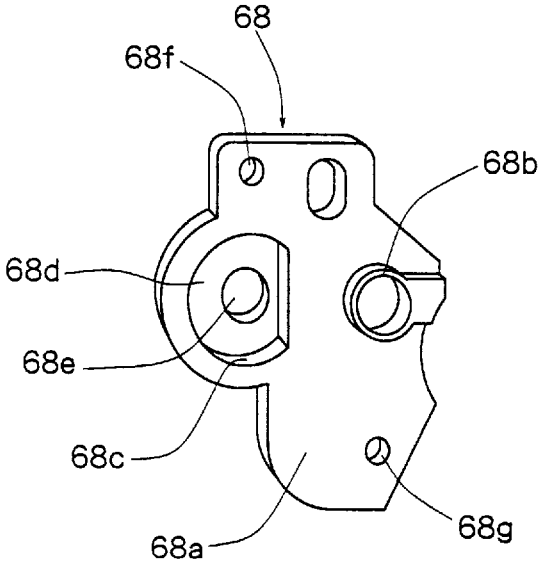
FIG. 6 is a perspective view of a third bearing member constituting the bearing structure shown in FIG. 4.
Figure 7:
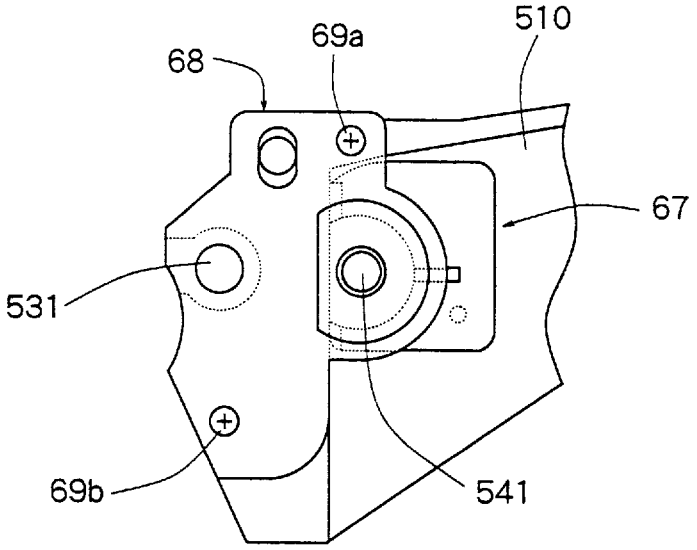
FIG. 7 is a front view of the bearing structure shown in FIG. 4.

Next, the third bearing member 68 will be described with reference also to FIG. 6. The third bearing member 68 is made of a suitable plastic material, and includes a main body 68*a*, a bearing 68*b* that is provided in the main body 68*a* and rotatably supports the other end of the rotary shaft 531 constituting the developing roller 53, and a fitting recess 68*c* of a shape corresponding, in cross section, to the boss of the bearing 67*b* provided in the second bearing member 67. In the end wall 68*d* forming the fitting recess 68*c* is formed an escape hole 68*e* having a diameter slightly larger than the outer diameter of the other end of the rotary shaft 531. In the third bearing member 68 are further formed two screw insertion holes 68*f* and 68*g* at positions corresponding to the two threaded holes 510*e* and 510*f* formed in the front side wall 510. To mount the thus constituted third bearing member 68 on the front side wall 510 of the developing housing 51, the other end of the rotary shaft 531 of the developing roller 53 is positioned in the hole 510*b* through the opening 510*c* formed in the front side wall 510. Here, the developing roller 53 is positioned in a manner that the roller 532 is press-contacted with the roller 542 constituting the feeding roller 54. After the other end of the rotary shaft 531 of the developing roller 53 is positioned in the hole 510*b* as described above, the hole of the bearing 68*b* is fitted to the other end of the rotary shaft 531. And the fitting recess 68*c* formed in the third bearing member 68 is fitted to the boss of the bearing 67*b* provided in the second bearing member 67, the screws 69*a* and 69*b* are inserted in the screw insertion holes 68*f* and 68*g*, and are screwed into the threaded holes 510*e* and 510*f* formed in the front side wall 510, so that the third bearing member 68 is mounted on the front side wall 510 of the developing housing 51 at a predetermined position as shown in FIG. 7.

In a state where the second bearing member 67 and the third bearing member 68 are mounted on the front side wall 510 of the developing housing 51, the fitting recess formed in the third bearing member 68 is fitted to the boss of the bearing 67*b* provided in the second bearing member 67 so that a relative positional relationship between the second bearing member 67 and the third bearing member 68 is defined. Therefore, the boss of the bearing 67*b* provided in the second bearing member 67 and the fitting recess 68*c* formed in the third bearing member 68 work as a positioning means for defining the relative positional relationship between the second bearing member 67 and the third bearing member 68. Accordingly, the accuracy of distance between the rotary shaft 541 of the feeding roller 54 supported by the bearing 67*b* of the second bearing member 67 and the rotary shaft 531 of the developing roller 53 supported by the bearing 68*b* of the third bearing member 68 is confined within the tolerance of fitting between the boss of the bearing 67*b* and the fitting recess 68*c*. The feeding roller 54 and the developing roller 53 are driven by a drive mechanism such as of gears mounted at the ends of the rotary shafts on the side supported by the first bearing member 65 equipped with bearings 65*a* and 65*b* for the two rotary shafts, generating less vibration.

Figure 8:
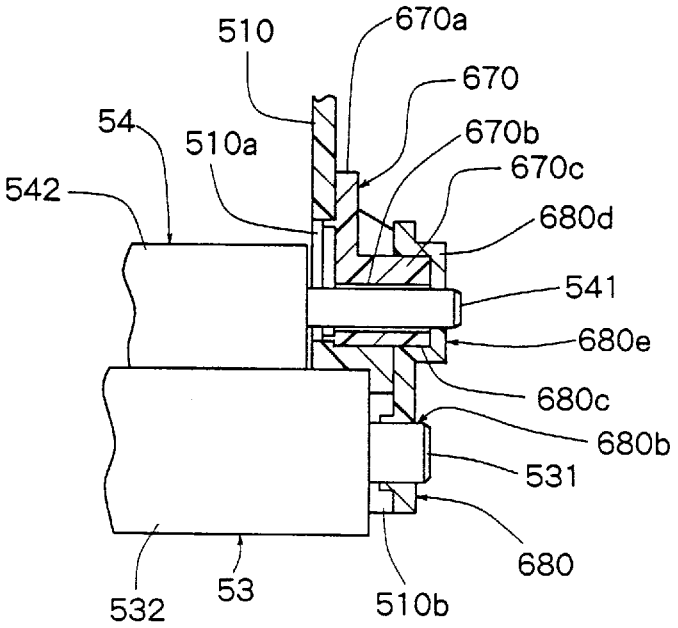
FIG. 8 is a sectional view illustrating another embodiment of the bearing structure for supporting the other end of the developing roller and the other end of the feeding roller constituting the electrostatic latent image developing device shown in FIG. 2.

Next, another embodiment of the second bearing member and of the third bearing member will be described with reference to FIG. 8.

The second bearing member 670 according to this embodiment has a positioning boss 670*c* with an insertion hole 670*b* at a position corresponding to the bearing 67*b* of the above-mentioned bearing member 67, of the main body 670*a*. The insertion hole 670*b* has a diameter which is slightly larger than the diameter of the rotary shaft 541 of the feeding roller 54. In a state where the rotary shaft 541 of the feeding roller 54 is inserted in the insertion hole 670*b*, therefore, the positioning boss 670*c* having the insertion hole 670*b* works to temporarily support the other end of the rotary shaft 541. In other respects, the second bearing member 670 of this embodiment has substantially the same constitution as that of the above-mentioned second bearing member 67.

The third bearing member 680 according to this embodiment has a bearing 680*e* for rotatably supporting the other end of the rotary shaft 531 constituting the feeding roller 54, the bearing 680*e* being mounted on an end wall 680*d* forming a fitting recess 680*c*, that corresponds to the positioning boss 670*c*, formed on the main body 680*a*. Reference numeral 680*b* denotes a bearing for supporting the other end of the rotary shaft 531 constituting the developing roller 53, and corresponds to the bearing 68*b* provided in the second bearing member 67. In other respects, the third bearing member 680 according to this embodiment has substantially the same constitution as that of the above-mentioned second bearing member 68. In a state where the second bearing member 670 and the third bearing member 680 are mounted on the front side wall 510 of the developing housing 51, therefore, the other end of the rotary shaft 541 constituting the feeding roller 54 is supported by the bearing 680*e* provided in the third bearing member 680, and the other end of the rotary shaft 531 constituting the developing roller 53 is supported by the bearing 680*b* provided in the third bearing member 680. Accordingly, the distance between the two rotary shafts is maintained at a predetermined value at all times. To mount the bearing member on the front side wall 510 of the developing housing 51 according to this embodiment, the other end of the rotary shaft 541 constituting the feeding roller 54 is temporarily supported by the positioning boss 670*c* having an insertion hole 670*b*, formed on the second bearing member 670, and the fitting recess 680*c* formed in the third bearing member 680 is fitted to the positioning boss 670*c*, enabling the rotary shaft 541 of the feeding roller 54 to be supported by the bearing 680*e* of the bearing member 680 to facilitate the assembling operation.

Reverting to FIG. 2, a stirrer means 55 is disposed in the stirrer chamber 514 of the developing housing 51. The stirrer means 55 is disposed in parallel with the feeding roller 54, and includes a rotary shaft 551 rotatably mounted on the front and rear side walls 510, 512 constituting the developing housing 51, a stirrer member 552 secured to the rotary shaft 551, and an elastic stirrer sheet member 553 mounted on the stirrer member 552. The stirrer member 552 is made of a plastic material, and has a plurality of openings in the lengthwise direction (direction perpendicular to the surface of the paper in FIG. 2). The stirrer sheet member 553 is made of a polyethylene terephthalate (PETP) resin having flexibility, and is secured with an adhesive to the front edge of the stirrer member 552. The thus constituted stirrer means 55 is continuously rotated by a drive means that is not shown in a direction indicated by an arrow in FIG. 2.

Described below is the developing agent-limiting means 56. The developing agent-limiting means 56 has a flexible and elastic blade 561 that is press-contacted to the peripheral surface of the roller 532 constituting the developing roller 53. The limiting blade 561 is made of a stainless steel plate or a spring steel plate which is, for example, about 0.1 to 0.2 mm thick, and has nearly the same size as the length in the lengthwise direction of the roller 532 constituting the developing roller 53. The limiting blade 561 has a mounting portion 561*a* and a limiting portion 561*b*. A limiting member 562 made of an urethane rubber is mounted on the surface (of the side opposed to the developing roller 53) of the limiting portion 561*b* constituting the limiting blade 561. In the illustrated embodiment, the limiting member 562 has a semicircular shape in cross section with a radius of about 1 mm, has nearly the same length as the limiting blade 561 in the lengthwise direction, and is mounted on the surface of the limiting portion 561*b* at its flat portion with an adhesive. The mounting portion 561*a* of the limiting blade 561 is mounted, by using a holder plate 563, on a blade-mounting portion 511*a* provided at the open end of the bottom wall 511 constituting the developing housing 51 on the side of the photosensitive unit 40. In the illustrated embodiment, elastic members 564, 564 made of an urethane rubber sheet of about 0.2 to 0.3 mm in thickness are disposed between the mounting portion 561*a* of the limiting blade 561 and the holder plate 563 and between the mounting portion 561*a* and the blade-mounting portion 511*a* of the developing housing 51. A plurality of screw insertion holes are formed in the blade-mounting portion 511*a* of the developing housing 51, in the mounting portion 561*a* of the limiting blade 561, in the elastic members 564, 564 and in the holder plate 563 at their corresponding positions in the lengthwise direction at a predetermined distance. A plurality of screws 565 are inserted in the plurality of screw insertion holes formed in the above-mentioned members from the side of the blade-mounting portion 511*a* of the developing housing 51, and male screw portions 565*a* formed at the ends of the screws 565 are screwed into female screws 563*a* formed in the screw insertion holes of the holder plate 563, so that the mounting portion 561*a* of the limiting blade 561 is held by the holder plate 563 and is tightly secured to the blade-mounting portion 511*a* of the developing housing 51 via elastic members 564, 564. Thus, the mounting portion 561*a* of the limiting blade 561 is mounted on the blade-mounting portion 511*a* of the developing housing 51 via the elastic members 564, 564 and hence, the tightening force of the screws 565 is weakened by the elastic members 564, 564. Therefore, the holder plate 563 is not deformed so much despite it is not so rigid, and the limiting blade 561 hardly undergoes deformation of the holder plate 563 due to the tightening force of the screws 565. The illustrated embodiment has dealt with the case where the elastic members 564, 564 were arranged on both sides of the mounting portion 561*a* of the limiting blade 561. However, even when the elastic member 564 only is disposed between the mounting portion 561*a* of the limiting blade 561 and the holder plate 563, deformation of the limiting blade 561 is decreased to a sufficient extent though the tightening force is less weakened than when the elastic members are arranged on both sides.

On the upper side of the blade-mounting portion 511*a* of the developing housing 51 is formed a fulcrum member-mounting portion 511*b* in the back-and-forth direction (in a direction perpendicular to the surface of the paper in FIG. 2). In the illustrated embodiment, the fulcrum member-mounting portion 511*b* is formed by a groove of an arcuate shape in cross section. A fulcrum member 566 is disposed on the fulcrum member-mounting portion 511*b*. In the illustrated embodiment, the fulcrum member 566 is constituted by a metallic round rod of a diameter of, for example, 2 mm, and has a length nearly equal to that of the limiting plate 561 in the lengthwise direction. The fulcrum member 566 is placed on the fulcrum member-mounting portion 511*b*, and is brought into contact with the back surface (surface of the side opposite to the surface on where the limiting member 562 is mounted) between the mounting portion 561*a* of the limiting blade 561 and the limiting portion 561*b*. It is desired that the fulcrum member 566 is disposed at such a position that the contacting position of the limiting blade 561 is as remote as possible from the limiting member 562 from the standpoint of decreasing the size of the limiting blade 561. In the thus constituted developing agent-limiting means 56, the limiting blade 561 is deflected with the fulcrum member 566 as a fulcrum, and the limiting member 562 mounted on the surface of the limiting portion 561*b* is brought into pressed contact with the peripheral surface of the roller 532 that constitutes the developing roller 53 in the developing agent-limiting zone 534. The developing agent-limiting means 56 is constituted as described above, and the fulcrum member 566 which forms a fulcrum of deflection for the limiting blade 561 is constituted by a round rod, making it possible to obtain a fulcrum portion with a relatively good precision at a reduced cost. Though the illustrated embodiment has used a round rod as a fulcrum member 566, it is also allowable to use a square rod.

A closure 57 is mounted on the developing housing 51 for covering the open top thereof. The closure 57 is formed of a plastic material, and is secured with an adhesive to the upper surfaces of the front and rear side walls 510, 512, a left side wall 513 and a coupling member 517 that constitute the developing housing 51. On the inner surface of the closure 57, a limiting portion 571 is integrally formed at a position opposed to the feeding roller 54 to extend in the back-and-forth direction (direction perpendicular to the surface of the paper in FIG. 2) and to protrude toward the developing chamber 515. A predetermined distance is maintained between the lower end of the limiting portion 571 and the outer peripheral surface of the roller 542 constituting the feeding roller 54. In the illustrated embodiment, a sheet-like sealing member 58 is mounted on the coupling member 517 constituting the developing housing 51. The sheet-like sealing member 58 is constituted by a flexible sheet member formed of, for example, a polyethylene terephthalate (PETP) and has nearly the same length as that of the roller 532 constituting the developing roller 53 in the axial direction thereof. The sheet-like sealing member 58 is secured at its one end portion to the coupling member 517 by a securing means such as an adhesive, and is curved at its other end portion and is brought into resilient contact with the peripheral surface of the roller 532 constituting the developing roller 53. The thus constituted sheet-like sealing member 58 prevents the developing agent from scattering through the opening of the developing housing 51 on the side of the photosensitive unit 40 in cooperation with the blade 561 of the developing agent-limiting means 56.

As shown in FIG. 1, the thus constituted process unit 4 is detachably mounted on the machine housing 20 of the printer 2. That is, the cover 23 constituting the machine housing 20 of the printer 2 is turned counterclockwise on the shaft 22 in FIG. 1, whereby the upper side of the housing body 21 constituting the machine housing 20 is opened. Then, the process unit 4 is mounted in the housing body 21 from the upper side. In the housing body 21 is provided a positioning means (not shown) capable of placing the photosensitive unit 40 of the process unit 4 at a predetermined position. After the process unit 4 is mounted in the housing body 21 of the machine housing 20, the cover 22 is turned clockwise about the shaft 22 in FIG. 1, thereby to close the upper portion thereof.

Referring to FIG. 1, a laser unit 24 is disposed at the lower part of the housing body 21 which constitutes the machine housing 20 of the printer 2. The laser unit 24 projects a laser beam corresponding to print data from, for example, a word processor connected to the printer 2, onto the photosensitive layer of the photosensitive drum 42 in the electrostatic latent image-forming zone 423 in the process unit 4, thereby to form an electrostatic latent image. In the housing body 21 constituting the machine housing 20 of the printer 2 are disposed a pair of fixing rollers 25 on the downstream side of the post-transfer guide plate 46. On the downstream side of the pair of fixing rollers 25 are disposed a pair of discharge rollers 26. On the downstream side of the pair of discharge rollers 26 is further disposed a paper discharge tray 27.

Referring to FIG. 1, on the left upper part of the cover 23 constituting the machine housing 20 of the printer 2 is disposed a paper feed tray 28 on which will be placed the transfer papers. A paper feed roller 29 is disposed on the downstream side of the paper feed tray 28, and is driven by a drive means that is not shown in a direction indicated by an arrow in FIG. 1. A friction pad 30 for separating the paper is disposed being opposed to the paper feed roller 29. In the transfer zone 422, furthermore, a non-contact type transfer roller 31 is disposed being opposed to the photosensitive drum 42. The transfer roller 31 is formed of an electrically conducting foamed urethane and is rotatably supported by the cover 23. The transfer roller 31 has, at its both ends, collars (not shown) made of an insulating material such as a plastic material having an outer diameter larger than that of the transfer roller 31, the collars being brought into contact with the peripheral surface of the photosensitive drum 42. Therefore, the transfer roller 31 is driven in a slipping manner with the rotation of the photosensitive drum 42. A gap of about 0.5 mm is maintained between the peripheral surface of the transfer roller 31 and the peripheral surface of the photosensitive drum 42. A constant current of, for example, 10 $\mu$A is permitted to flow into the thus constituted transfer roller 31. Furthermore, an upper guide plate 452 constituting the other one of the pair of pre-transfer guide plates 45 is disposed in the cover 23.

The printer 2 equipped with the electrostatic latent image developing device in the illustrated embodiment is constituted as described above. The actions will now be described.

Based on a print command from a word processor or the like that is not shown, the above-mentioned members start operating, and the photosensitive layer on the surface of the photosensitive drum 42 is charged substantially uniformly to a predetermined polarity by the corona discharger 43 for electric charging. Then, a laser beam of the laser unit 24 corresponding to the print data from the word processor or the like, is irradiated onto the surface of the charged photosensitive layer of the photosensitive drum 42, thereby to form an electrostatic latent image. The electrostatic latent image thus formed on the photosensitive layer of the photosensitive drum 42 is developed into a toner image by the developing action of the developing unit 50. The developing action of the developing unit 50 will be described later in detail. The transfer papers placed on the paper feed tray 28 are fed piece by piece by the action of the paper feed roller 29 and of the friction pad 30. The transfer paper is guided by the pair of pre-transfer guide plates 45, conveyed to between the photosensitive drum 42 and the transfer roller 31, and the toner image formed on the photosensitive drum 42 is transferred onto the surface of the transfer paper. The transfer paper onto which the toner image has been transferred is guided by the post-transfer guide plate 46 and is conveyed to the pair of fixing rollers 25. The transfer paper onto which the toner image has been heat-fixed by the pair of fixing rollers 25 is discharged by the pair of discharge rollers 26 onto the paper discharge tray 27. When the peripheral surface of the photosensitive drum 42 that has passed through the transfer zone 425 passes through the foreign matter-recovering brush 44, foreign matters such as paper dust adhered to the peripheral surface thereof are removed by the foreign matter-recovering brush 44. At this moment, residual toner adhered to the peripheral surface of the photosensitive drum 42 is also removed together with foreign matters such as paper dust. The residual toner that is removed may not be reliably trapped by the foreign matter-recovering brush 44 but may fall frequently. The toner that has fallen and deposited on the corona discharger 431 could become a cause of irregular charging. In the illustrated embodiment, however, the toner that has fallen is prevented from infiltrating into the corona discharger 431 owing to the wall 47 for preventing the infiltration of toner.

The developing action of the developing unit 50 will be described next.

Upon starting the operation of the developing unit 50, the developing roller 53, feeding roller 54 and stirrer means 55 are rotated by a drive means that is not shown in the directions indicated by arrows. With rotation of the stirrer member 552 and the stirrer sheet member 553 constituting the stirrer means 55 in the direction indicated by an arrow, the developing agent contained in the stirrer chamber 514 is stirred, climbs over the partitioning wall 516, and is fed into the developing chamber 514 from the upper side of the feeding roller 54. Here, the limiting member 571 formed on the inner surface of the closure 57 so works that the developing agent will not be supplied in excess amounts into the developing chamber 514. The developing agent fed by the stirrer means 55 is put on the roller 542 of the feeding roller 54 and is conveyed to a nip portion which is the developing agent-holding zone 533. The feeding roller 54 and the developing roller 53 rotate in the same direction from the upper side toward the lower side in the developing agent-holding zone 533 which is the nip portion. Therefore, the developing agent is sufficiently supplied from the feeding roller 54 to the developing roller 53, without causing a short supply. Besides, the feeding roller 54 and the developing roller 53 rotate in the same direction in the developing agent-holding zone 533 which is the nip portion as described above and hence, is reliably rotated without requiring a large driving force.

The developing agent conveyed to the developing agent-holding zone 533 which is the nip portion constituted by the feeding roller 54 and the developing roller 53 is held by the peripheral surface of the roller 532 that constitutes the developing roller 53 and is conveyed toward the developing agent-limiting zone 534. Here, the feeding roller 54 and the developing roller 53 rotate in the same direction from the upper side toward the lower side in the developing agent-holding zone 533 which is the nip portion. Accordingly, the developing agent passes through the nip portion constituted by the above two rollers, held by the developing roller 53, and is conveyed to the developing agent-limiting zone 534 and to the developing zone 424. Thus, the developing agent is rubbed as it passes through the nip portion and is electrically charged to a sufficient degree, making it possible to prevent the occurrence of so-called fogging.

In the developing agent-limiting zone 534, the limiting member 562 mounted on the surface of the blade 561 constituting the developing agent-limiting means 56, acts on the developing agent held on the peripheral surface of the roller 532 of the developing roller 53, so that the amount of the developing agent held on the peripheral surface of the roller 532 is limited to form a thin layer thereof. In the developing agent-limiting zone 534, the developing agent is limited by the limiting member 562 mounted on the blade 561 of the developing agent-limiting means 56 and is scraped off onto the bottom wall 511 of the developing housing 51. Here, since the feeding roller 54 is rotating in a direction indicated by an arrow, the developing agent is kept conveyed along the guide surface 516*b* of the partitioning wall 516.

As described above, the developing agent is held on the peripheral surface of the roller 532 constituting the developing roller 53 in the developing agent-holding zone 533 and is formed into a thin layer in the developing agent-limiting zone 534 by the action of the limiting member 562 mounted on the limiting blade 561 of the developing agent-limiting means 56. The developing agent is then conveyed to the developing zone 424 with the rotation in the direction of arrow.

In the developing zone 424, the developing agent is applied to the electrostatic latent image on the photosensitive material provided on the peripheral surface of the photosensitive drum 42, whereby the electrostatic latent image is developed into the toner image. For example, the electrostatic latent image has a non-image region charged to about 600 V and an image region charged to about 120 V, and the toner as the developing agent is adhered to the image region (so-called reversal development). The photosensitive drum 42 and the developing roller 53 are rotated in the directions indicated by arrows in FIG. 2. In the developing zone 424, therefore, the peripheral surface of the photosensitive drum 42 and the peripheral surface of the roller 532 constituting the developing roller 53 are both moved in the same direction from the lower side toward the upper side. The peripheral velocity V2 of the roller 532 and the peripheral velocity V1 of the photosensitive drum 42 have been so set as to maintain a relationship $1.2\ V1 \leqq V2 \leqq 2.5\ V1$. The developing agent is conveyed in a sufficient amount to the developing zone 535 by the roller 532 of the developing roller 53, and the developing agent once adhered to the non-image portion of the electrostatic latent image is suitably peeled off due to the rubbing action of the peripheral surface of the roller 532 against the peripheral surface of the photosensitive drum 42. It is therefore allowed to obtain a good toner image having a suitable developing density without fogging. On the other hand, the used developing agent that has passed through the developing zone 424 being held on the peripheral surface of the roller 532 constituting the developing roller 53, is transferred onto the surface of the feeding roller 54 at a nip portion constituted by the developing roller 53 and the feeding roller 54. Here, the peripheral velocity of the feeding roller 54 is greater than the peripheral velocity of the developing roller 53 and the developing agent is moved at the nip portion. Therefore, the adhering force of the non-transferred developing agent adhered to the developing roller 53 is weakened at the time when it passes through the developing zone 535, and the non-transferred developing agent is recovered. Thus, it is made possible to prevent the occurrence of so-called ghost caused by the non-transferred developing agent that remains adhered to the developing roller 53.

The present invention was described above by way of embodiments of when being applied to a printer. The invention, however, is in no way limited to the illustrated embodiments only but can be adapted to, for example, an electrostatic copier, and can be varied or modified in a variety of ways without departing from the technical spirit and scope of the invention.

The electrostatic latent image developing device according to the present invention is constituted as described above, and exhibits actions and effects as described below.

That is, according to the present invention, the electrostatic latent image developing device comprises a first bearing member mounted on one side wall of the developing housing and having two bearings for supporting an end of the rotary shaft of the developing roller and an end of the rotary shaft of the feeding roller, a second bearing member mounted on the other side wall of the developing housing and having a bearing for supporting the other end of the one rotary shaft of the developing roller or the feeding roller, and a third bearing member mounted on the other side wall of the developing housing and having a bearing for supporting the other end of the other rotary shaft of the developing roller or the feeding roller, the second bearing member and the third bearing member being provided with a positioning means for defining a relative positional relationship between the two. Therefore, the assembling operation is easy, and the accuracy of distance between the two rotary shafts can be confined within the tolerance of fitting between the boss of the bearing and the fitting recess.

According to the present invention, furthermore, the electrostatic latent image developing device comprises a first bearing member mounted on one side wall of said developing housing and having two bearings for supporting an end of the rotary shaft of said developing roller and an end of the rotary shaft of said feeding roller, a second bearing member mounted on the other side wall of the developing housing and having a positioning boss with an insertion hole by which is temporarily supported the other end of the one rotary shaft of the developing roller or said feeding roller, and a third bearing member mounted on the other side wall of the developing housing and having a bearing for supporting the other end of the other rotary shaft of the developing roller or the feeding roller, the third bearing member being provided with a fitting recess which fits to the positioning boss provided on the second bearing member, and an end wall forming the fitting recess being provided with a bearing for supporting the end of the rotary shaft inserted in the insertion hole formed in the positioning boss. Therefore, the distance between the two rotary shafts is maintained at a predetermined value at all times, and the assembling operation is easy.

What we claim is:

1. An electrostatic latent image developing device equipped with a developing housing, a developing roller rotatably disposed between two side walls of said developing housing for holding developing agent on a peripheral surface thereof and for applying the thus held developing agent onto an electrostatic latent image, and a feeding roller rotatably disposed between the two side walls of said developing housing and neighboring said developing roller in order to feed the developing agent onto the peripheral surface of said developing roller, comprising:

a first bearing member mounted on one side wall of said developing housing and having two bearings for supporting a first end of a rotary shaft of said developing roller and a first end of a rotary shaft of said feeding roller;

a second bearing member mounted on the other side wall of said developing housing and having a bearing for bearing support of a second end of the rotary shaft of one of said developing and feeding rollers; and a third bearing member mounted on the other side wall of said developing housing and having a bearing for bearing support of a second end of the rotary shaft of the other of said developing and feeding rollers;

said second bearing member and said third bearing member being provided with a positioning means for defining a relative positional relationship between said second and third bearing members.

2. An electrostatic latent image developing device according to claim 1, wherein said positioning means is constituted by a boss of the bearing provided on said second bearing member and a fitting recess provided in said third bearing member, which fits to said boss.

3. An electrostatic latent image developing device according to claim 1, wherein said developing roller and said feeding roller are driven from the first ends of said rotary shafts which are supported by said first bearing member.

4. An electrostatic latent image developing device equipped with a developing housing, a developing roller rotatably disposed between two side walls of said developing housing for holding developing agent on a peripheral surface thereof and for applying the thus held developing agent onto an electrostatic latent image, and a feeding roller rotatably disposed between the two side walls of said developing housing and neighboring said developing roller in order to feed the developing agent onto the peripheral surface of said developing roller, comprising:

a first bearing member mounted on one side wall of said developing housing and having two bearings for supporting a first end of a rotary shaft of said developing roller and a first end of a rotary shaft of said feeding roller;

a second bearing member mounted on the other side wall of said developing housing and having a positioning boss with an insertion hole by which is temporarily supported a second end of the rotary shaft of one of said developing and feeding rollers; and a third bearing member mounted on the other side wall of said developing housing and having a bearing for supporting a second end of the rotary shaft of the other of said developing and feeding rollers;

said third bearing member being provided with a fitting recess which fits to said positioning boss provided on said second bearing member, and an end wall forming said fitting recess being provided with a bearing for supporting the second end of the rotary shaft inserted in said insertion hole formed in said positioning boss.

* * * * *